US006819977B2

(12) United States Patent
Howes, Jr. et al.

(10) Patent No.: US 6,819,977 B2
(45) Date of Patent: Nov. 16, 2004

(54) DISPENSER HAVING MULTIPLE MODES OF OPERATION

(75) Inventors: Ronald Bruce Howes, Jr., Minneapolis, MN (US); Robert Eugene May, Lakeville, MN (US); David Robert Howland, Aptos, CA (US)

(73) Assignee: Ecolab Inc., St. Paul, MN (US)

( * ) Notice: Subject to any disclaimer, the term of this patent is extended or adjusted under 35 U.S.C. 154(b) by 0 days.

(21) Appl. No.: 10/330,043

(22) Filed: Dec. 24, 2002

(65) Prior Publication Data

US 2004/0122555 A1 Jun. 24, 2004

(51) Int. Cl.[7] ..... G06F 7/00
(52) U.S. Cl. ..... 700/244; 700/240; 700/266
(58) Field of Search ..... 700/231, 236, 700/244, 240, 241, 266, 265, 285, 306; 137/88, 387, 2, 5, 552.7

(56) References Cited

U.S. PATENT DOCUMENTS

| | | | | |
|---|---|---|---|---|
| 2,333,791 A | | 11/1943 | Hutchison, Jr. | |
| 3,412,254 A | | 11/1968 | Meyer-Döering et al. | |
| 3,760,166 A | | 9/1973 | Adams et al. | |
| 4,046,996 A | | 9/1977 | Williams et al. | |
| 4,211,517 A | | 7/1980 | Schmid | |
| 4,396,828 A | | 8/1983 | Dino et al. | |
| 4,573,606 A | | 3/1986 | Lewis et al. | |
| 4,597,091 A | | 6/1986 | Blake | |
| 4,676,399 A | | 6/1987 | Burckhardt | |
| 4,711,370 A | | 12/1987 | Goudy, Jr. et al. | |
| 4,756,321 A | | 7/1988 | Livingston et al. | |
| 4,964,185 A | * | 10/1990 | Lehn | 8/158 |
| 4,980,292 A | | 12/1990 | Elbert et al. | |
| 5,014,211 A | * | 5/1991 | Turner et al. | 700/239 |
| 5,014,877 A | | 5/1991 | Roos | |
| 5,064,094 A | | 11/1991 | Roos et al. | |
| 5,147,615 A | | 9/1992 | Bird et al. | |
| 5,203,366 A | * | 4/1993 | Czeck et al. | 137/3 |
| 5,500,050 A | | 3/1996 | Chan et al. | |
| 5,638,417 A | | 6/1997 | Boyer et al. | |
| 5,671,262 A | | 9/1997 | Boyer et al. | |
| 5,826,749 A | * | 10/1998 | Howland et al. | 222/1 |
| 5,967,202 A | * | 10/1999 | Mullen et al. | 141/104 |
| 6,143,257 A | | 11/2000 | Spriggs et al. | 422/264 |
| 6,547,097 B1 | | 4/2003 | Cavallaro et al. | |

FOREIGN PATENT DOCUMENTS

| | | |
|---|---|---|
| WO | WO 98/26704 | 6/1998 |
| WO | WO 03/59143 | 7/2003 |

* cited by examiner

*Primary Examiner*—Khoi H. Tran
(74) *Attorney, Agent, or Firm*—IPLM Group, P.A.

(57) ABSTRACT

A dispenser for dispensing and a method of dispensing an ingredient for a machine. An ingredient feed mechanism dispenses the ingredient to the machine. A controller is capable of controlling an amount of the ingredient delivered to the machine by varying an amount of time the ingredient feed mechanism is active. The controller has a demand mode which varies the amount of time the ingredient feed mechanism is active as a function of a parameter obtained from the machine. The controller compares the amount of time the ingredient feed mechanism is active with a reference value and switches to a timed mode if the amount of time deviates from the reference value. The controller may have an initial training mode which measures the amount of time the ingredient feed mechanism is active establishes the reference value based upon the amount of time the ingredient feed mechanism is active.

10 Claims, 5 Drawing Sheets

DISPENSER HAVING MULTIPLE MODES OF OPERATION

TECHNICAL FIELD

This invention relates generally to dispensers suitable for delivering an ingredient, such as detergent, to a machine, such as a warewashing machine, and, more particularly to such dispensers responsive to a parameter of the machine, such as the concentration of the ingredient in the machine.

BACKGROUND

The use of dispensers to dispense a product, or an ingredient, to a machine utilizing the ingredient is well known in the art. Such dispensers may be used for many purposes, one of which is to provide detergent and/or bleach for washing operations.

The amount of ingredient dispensed or delivered to the machine can be a function of the amount of time that the dispenser is active. The longer time, or more time, that the dispenser is active, the more of the ingredient which is dispensed to the machine. Conversely, if the dispenser is active for a shorter time, or for less time, then less of the ingredient is dispensed to the machine.

Further, some controllers dispense the ingredient as a function of a parameter of the machine into which the ingredient is dispensed. In some cases, the ingredient is utilized in the machine in diluted form. As the active ingredient in the working solution of the machine is depleted through machine use, additional ingredient is then dispensed to the machine.

The depletion of the active ingredient can be based upon many factors, such as use of the machine, e.g., the volume of items processed by the machine, temperature and the characteristics of the diluent.

As the concentration level of the active ingredient in the working solution in the machine decreases, the controller can add an additional amount of the active ingredient to replenish the working solution. When the concentration falls too low, the dispenser can be activated until the concentration of the active ingredient returns to acceptable levels or to within the proper range.

One example of an ingredient dispenser is a detergent dispenser for a warewashing machine. A warewashing machine, in a commercial environment, can continuously process trays of dishes as such trays pass through the machine. Detergent is dispensed for optimum concentration of detergent in the detergent/water working solution in the machine. As trays of dishes pass through the warewashing machine, the effectiveness, i.e., the concentration of the detergent, of the working solution decreases.

The concentration of the working solution in the warewashing is monitored, typically by measuring conductivity, possibly in conjunction with temperature. Knowledge of the conductivity and the temperature of the working solution can help to determine the actual concentration of the detergent in the working solution.

However, a malfunction of the detergent dispensing system can lead to disappointing results. A malfunction can lead to too much detergent being dispensed. The dispensing of too much detergent incurs an extra cost of the wasted detergent. Too rich of a detergent solution can also pose increased environmental concerns. A malfunction can also result in ineffective operation of the machine. Not enough detergent can result in improper washing of dishes, possibly requiring the rewashing of the dishes causing a loss in time and expense.

SUMMARY OF THE INVENTION

There is a need for an ingredient (or detergent) controller which can detect a malfunction in the ingredient (detergent) replenishment system in order to prevent waste of the active ingredient (detergent) and to prevent improper operation of the machine due to an improper amount of the ingredient being dispensed to the machine.

In one embodiment, the present invention provides a dispenser for dispensing an ingredient for a machine. An ingredient feed mechanism is operatively coupled to dispense the ingredient to the machine and adapted to receive the ingredient. A controller is capable of controlling an amount of the ingredient delivered to the machine by varying an amount of time the ingredient feed mechanism is active. The controller has a demand mode which varies the amount of time the ingredient feed mechanism is active as a function of a parameter obtained from the machine. The controller compares the amount of time the ingredient feed mechanism is active with a reference value. The controller switches to a timed mode if the amount of time deviates from the reference value beyond a first predetermined deviation and which delivers the ingredient as a function of time.

In another embodiment, the present invention is a dispenser for dispensing a detergent for a warewashing machine. A detergent feed mechanism is operatively coupled to dispense the detergent to the warewashing machine and adapted to receive the detergent. A controller is capable of controlling an amount of the detergent delivered to the warewashing machine by varying an amount of time the detergent feed mechanism is active. The controller has a demand mode which varies the amount of time the detergent feed mechanism is active as a function of a concentration of the detergent in the warewashing machine. The controller compares the amount of time the detergent feed mechanism is active with a reference value. The controller switches to a timed mode if the amount of time deviates from the reference value beyond a first predetermined deviation and which delivers the detergent as a function of time.

In a preferred embodiment, the controller has an initial training mode which measures the amount of time the ingredient feed mechanism is active over a predetermined period of time while delivering the ingredient in accordance with the parameter and establishes the reference value based upon the amount of time the ingredient feed mechanism is active.

In a preferred embodiment, the controller switches back to the demand mode if the amount of time returns to within a second predetermined deviation from the reference value.

In a preferred embodiment, the first predetermined deviation is a result of the amount of time exceeding the reference value.

In a preferred embodiment, the amount of time is determined by a moving average.

In a preferred embodiment, the moving average is determined by an FIR filter having a time constant of at least one hour.

In a preferred embodiment, the parameter is a concentration value of the ingredient in the machine.

In a preferred embodiment, the controller in the timed mode delivers the ingredient solely as a function of time.

In another embodiment, the present invention is a method of dispensing ingredient for a machine, the machine have a ingredient feed mechanism operatively coupled to dispense the ingredient to the machine and adapted to receive the ingredient; and a controller capable of controlling an amount of the ingredient delivered to the machine by varying an amount of time the ingredient feed mechanism is active. In a demand mode, the amount of time the feed mechanism is active is varied as a function of a concentration of the ingredient in the machine. The amount of time the ingredient feed mechanism is active is compared with a reference value. The controller switches to a timed mode in which the ingredient is delivered as a function of time if the amount of time deviates from the reference value beyond a first predetermined deviation.

In another embodiment, the present invention provides a method of dispensing detergent for a warewashing machine, the warewashing machine have a detergent feed mechanism operatively coupled to dispense the detergent to the warewashing machine and adapted to receive the detergent; and a controller capable of controlling an amount of the detergent delivered to the warewashing machine by varying an amount of time the detergent feed mechanism is active. In a demand mode, the amount of time the detergent feed mechanism is active is varied as a function of a concentration of the detergent in the warewashing machine. The amount of time the detergent feed mechanism is active is compared with a reference value. The controller switches to a timed mode in which the detergent is delivered as a function of time if the amount of time deviates from the reference value beyond a first predetermined deviation.

In a preferred embodiment, the method first, in a training mode, measures the amount of time the ingredient feed mechanism is active over a predetermined period of time while delivering the ingredient in accordance with the parameter and establishes the reference value based upon the amount of time the ingredient feed mechanism is active.

In a preferred embodiment, the method switches back to the demand mode if the amount of time returns to within a second predetermined deviation from the reference value.

In a preferred embodiment, the first predetermined deviation is a result of the amount of time exceeding the reference value.

In a preferred embodiment, the amount of time is determined by a moving average.

In a preferred embodiment, the moving average is determined by an FIR filter having a time constant of at least one hour.

In a preferred embodiment, the method, in the timed mode, delivers the ingredient solely as a function of time.

DETAILED DESCRIPTION

Figure 1:
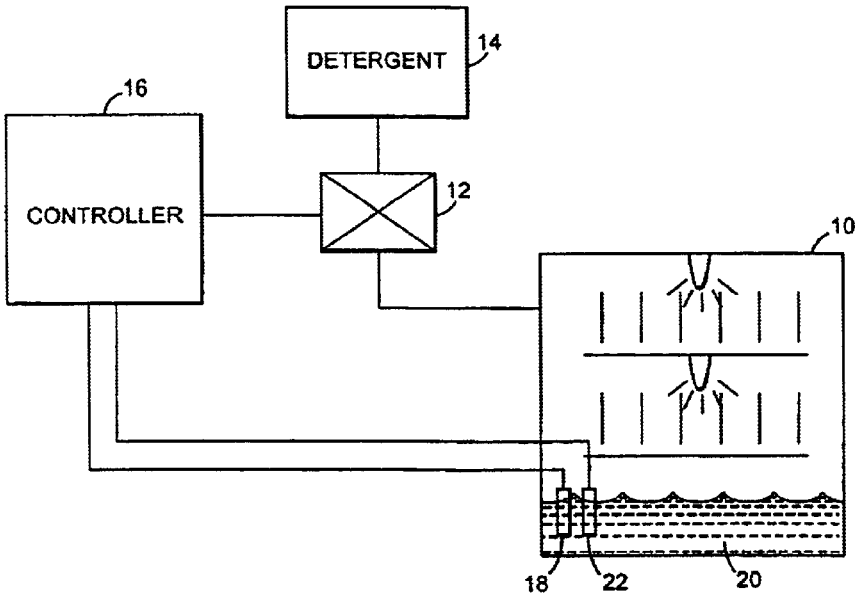
FIG. 1 illustrates a functional block diagram of a warewashing machine in which the present invention finds usefulness.

In FIG. 1, warewashing machine 10 is but one example of equipment in which the present invention finds usefulness. Warewashing machine 10, is conventional and well known in the art. Warewashing machine 10 can be a conveyor machine which operates in continuous feed fashion with trays of dishes traveling through the machine or could be a door machine having set cycles and requiring the opening of a door to insert and remove dishes.

Detergent feed mechanism 12 is operatively coupled to warewashing machine 10. Detergent feed mechanism 12 receives detergent 14 from a detergent supply or a detergent source. Detergent feed mechanisms 12 are well known in the art. When controller 16 activates detergent feed mechanism 12, detergent 14 is dispensed to warewashing machine 10. The amount of detergent 14 which is delivered to warewashing machine 10 is directly related to the amount of time that detergent feed mechanism 12 is active.

In a preferred embodiment, detergent controller 16 activates detergent feed mechanism 12 based upon parameters obtained from warewashing machine 10. Conductivity probe 18 measures the conductivity of working solution 20 of detergent and water contained in warewashing machine 10 and transmits a signal to detergent controller 16 which is indicative of that conductivity. Temperature probe 22 measures the temperature of working solution 20 and transmits a signal to detergent controller 16 indicative of that temperature. Controller 16 can then determine the concentration of detergent 14 in working solution 20 based upon the conductivity and temperature by conventional means. Having knowledge of the concentration of detergent 14 in working solution 20 allows controller 16 to activate feed mechanism 12 in order to maintain the desired concentration of detergent 14 in working solution 20. This feedback and control mechanism is conventional and is well known in the art.

However, if the detergent delivery mechanism described above malfunctions in any way, the automatic feedback technique to properly replenish warewashing machine 10 with detergent 14 may fail. This may result in either too much or too little detergent 14 being delivered to warewashing machine 10 either wasting detergent 14 and money or resulting in an improper wash, respectively. Note that the malfunction in detergent 14 deliver could be the result of any number reasons including, for example, a malfunction in controller 16 itself, a malfunction of either conductivity probe 18 or temperature probe 22 or a malfunction in warewashing machine 10 such as a leaking drain for working solution 20.

In an embodiment, controller 16 detects a malfunction and, at least temporarily, halts the automatic feedback and detergent delivery scheme described above and switches to a timed mode of detergent 14 delivery based upon historical times of activation of feed mechanism 12. In a still preferred embodiment, controller 16 can then also determine if and when the delivery of detergent 14 to warewashing machine 10 returns to norms and resume automatic feedback operation, if desired. Alternatively, automatic feedback mode is not resumed until manually reset, e.g., by a qualified service technician.

Figure 2:
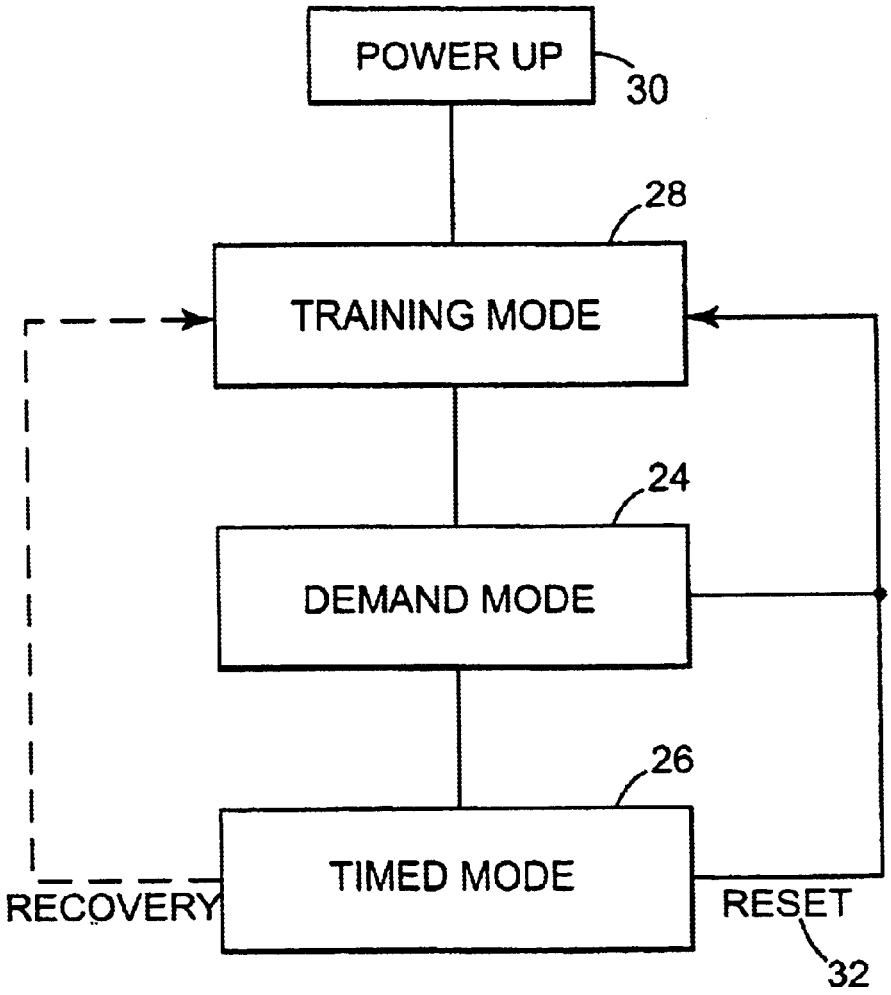
FIG. 2 is a flow diagram illustrating the various modes of operation of the present invention.

Controller 16 has multiple modes of operation, a demand mode 24, a timed mode 26, and, preferably, a training mode 28. Movement among each of these modes of operation is illustrated in FIG. 2.

In a preferred embodiment, controller 16 upon power up 30 initially enters training mode 28. In training mode 28, controller 16 empirically determines a reference value for the amount of time that feed mechanism 12 is active. Once the reference value is determined, controller 16 proceeds to demand mode 24. Alternatively, the reference value for the amount of time that feed mechanism should be active can be determined in another manner such as by being preset at the factory. If the reference value is preset, for example, controller 16 may enter demand mode 24 directly from power up 30 without passing through training mode 28.

In demand mode 24, controller 16, in addition to all of its normal automatic feedback delivery functions, monitors the amount of time that feed mechanism 12 is active and compares that amount of time with the previously established reference value. As long as the measured amount of time matches relatively closely with the reference value, controller 16 continues in demand and continues to monitor for an abnormality in the detergent delivery process. However, if the measured amount of time deviates from the reference value, either at all or by a predetermined amount (either absolute or comparatively, such as a percentage), then controller 16 has sensed an abnormality in the detergent delivery process (an error) and switches to timed mode 26.

In timed mode 26, controller 26 delivers detergent 14 to warewashing machine 10 by activating feed mechanism 12 according to a preset timed schedule. For example, if during training it is determined that feed mechanism is active a percentage of time, then controller 16 may revert to activating feed mechanism that same percentage of time instead of allowing the automatic feedback process to continue. Alternatively, a preset timed percentage or schedule could be preset at the factory to which controller 16 defaults during timed mode 26.

In one embodiment, after entering timed mode 26, controller 16 must be manually reset 32, preferably to training mode 28, if applicable, and alternatively back to demand mode 24, after repairs to the detergent delivery system have been made.

In an alternative embodiment, controller 16 in timed mode 26 continues to monitor the amount of time that feed mechanism 12 is active and compares that measured amount of time with the reference value, or with a moving reference value, and, if and when the measured amount returns to within another predetermined deviation from the reference value, controller 16 may return to demand mode 24 and again implement the well known automatic feedback control technique.

Figure 3:
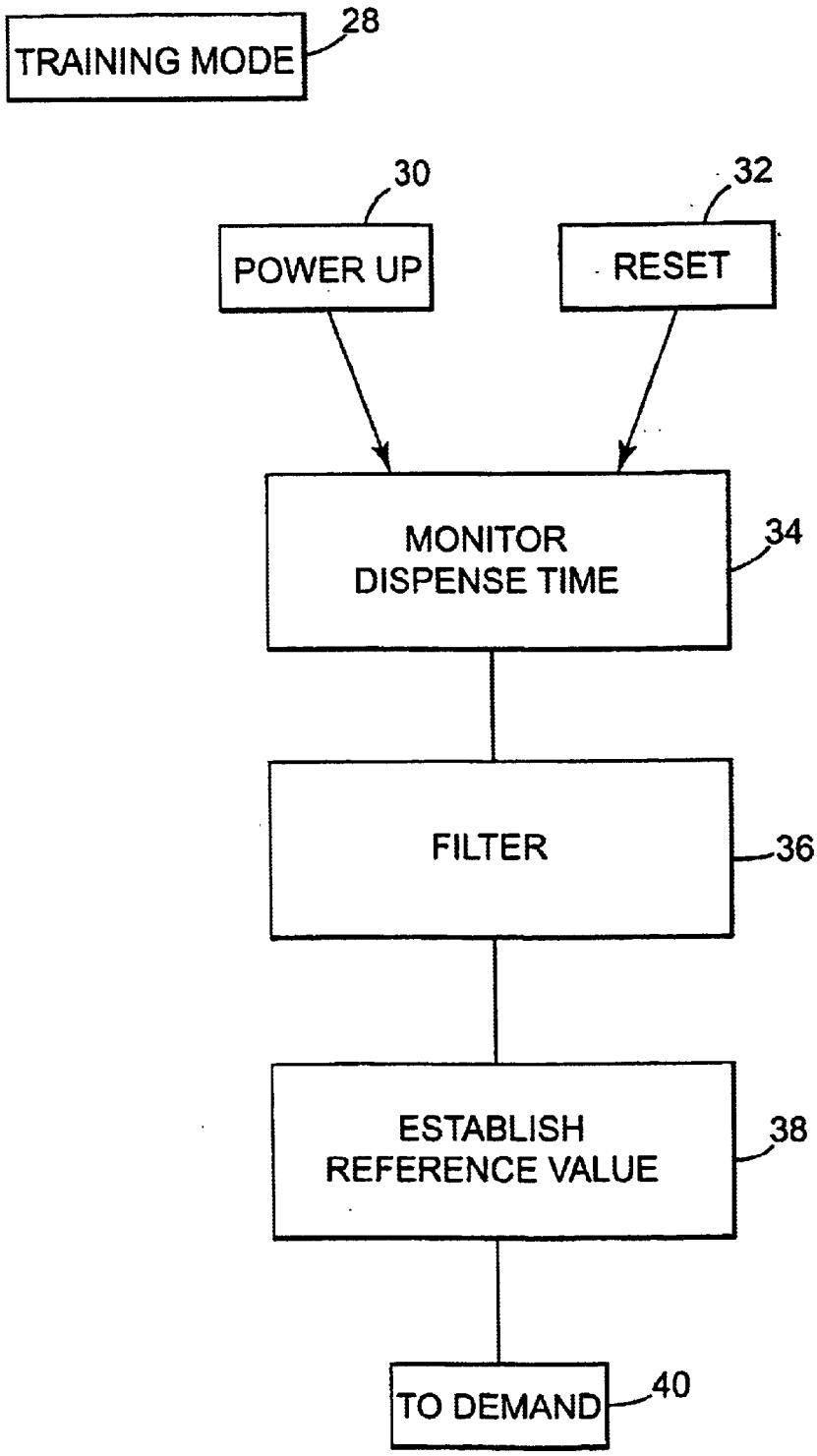
FIG. 3 is a flow diagram illustrating operation of a training mode of an embodiment of the present invention.

Training mode 28 is illustrated in more detail in FIG. 3. Again, training mode is entered either by power up 30 or by manual reset 32. The amount of time that feed mechanism 12 is active is monitored in step 34. Monitoring is accomplished by determining whether feed mechanism 12 is "on" or "active" time each 0.1 second repeatedly over ten second periods. With one hundred 0.1 second monitoring steps in each 10 second period, an "on" or "active" time can be determined with a resolution of one percent.

The result of each ten second monitoring period is input into a second order FIR filter 36. The ten second monitoring period becomes the sampling period for the filter 36. A relatively long time constant is utilized for the filter 36 in order to reduce or eliminate transients. In a preferred embodiment, the time constant for the filter 36 should be at least three hours, preferably between three and four hours, and, in another embodiment, approximately twelve hours. Having a relatively long time constant allows controller 16 to determine a relatively slowly moving average for the amount of time that feed mechanism 12 is active. Controller 16 is allowed to run in training mode for a period of time in order to establish a reference value for the amount of time that feed mechanism 12 is active. The long time constant of the filter 36 establishes a relatively slowly moving average for the reference value. Thus, the reference adapts slowly over time to the changing operating characteristics of warewashing machine 10.

Preferably, controller 16 continues to operate in training mode 28 for four time constants before initially establishing the reference value. If the time constant for filter 36 is twelve hours, then the period for training mode 28 is approximately 48 hours. If the time constant for filter 36 is three hours, then the period for training mode 28 is approximately twelve hours. These relatively long periods spent in training mode 28 allows controller 16 to establish a relatively stable, relatively slowly moving value for reference value.

Once the training period, e.g., 12 to 48 hours, expires, controller 16 establishes (38) an initial value to be used as a reference value with which to compare future measured amounts of time that feed mechanism 12 is active and controller 16 moves (40) to demand mode 24.

Figure 4:
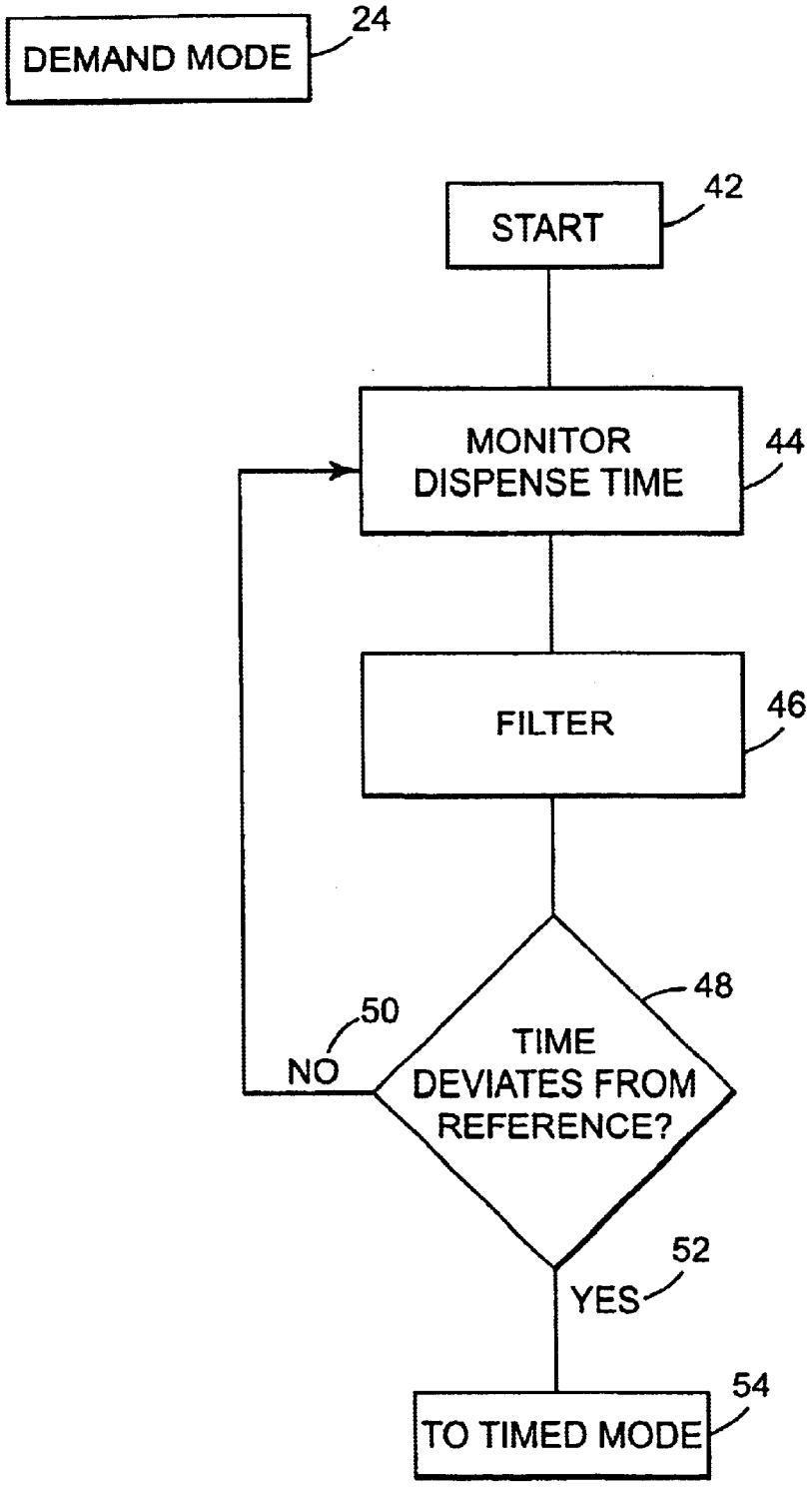
FIG. 4 is a flow diagram illustrating operation of a demand mode of the present invention.

Demand mode 24 (FIG. 4) begins in step 42. The amount of time that feed mechanism 12 is active continues to be monitored using the same sampling and filtering techniques used during training mode 28. The amount of "on" or "active" time for feed mechanism 12 is monitored 44 using the same 0.1 second intervals in ten second periods as used in training mode 28. Each sampled period is filtered 46 used a second order FIR filter with a time constant of several hours as in training mode.

In fact, the sampling and filtering algorithms used in training mode 28 can be reused in demand mode. The difference is that in training mode 28, the sampling and filtering algorithms are used to establish a reference value and in demand mode 24 the same sampling and filtering algorithms are used to measure a relatively slowly moving average of the amount of time that feed mechanism 12 is active.

The measured active times determined in demand mode 24 are compared 48 with the reference value established in training mode 28. If the measured active time does not deviate significantly (50) from the established reference value, controller 16 returns to monitoring step 44 and filtering step 46 before again comparing 48 the measured active time with the established reference value. If the measured active time significantly deviates (52) from the established reference value, then controller 16 proceeds (54) to timed mode 26.

In the preferred embodiment, deviates significantly initially means plus or minus fifty percent (50%). This deviation may be adjusted manually up or down depending upon empirical results.

Figure 5:
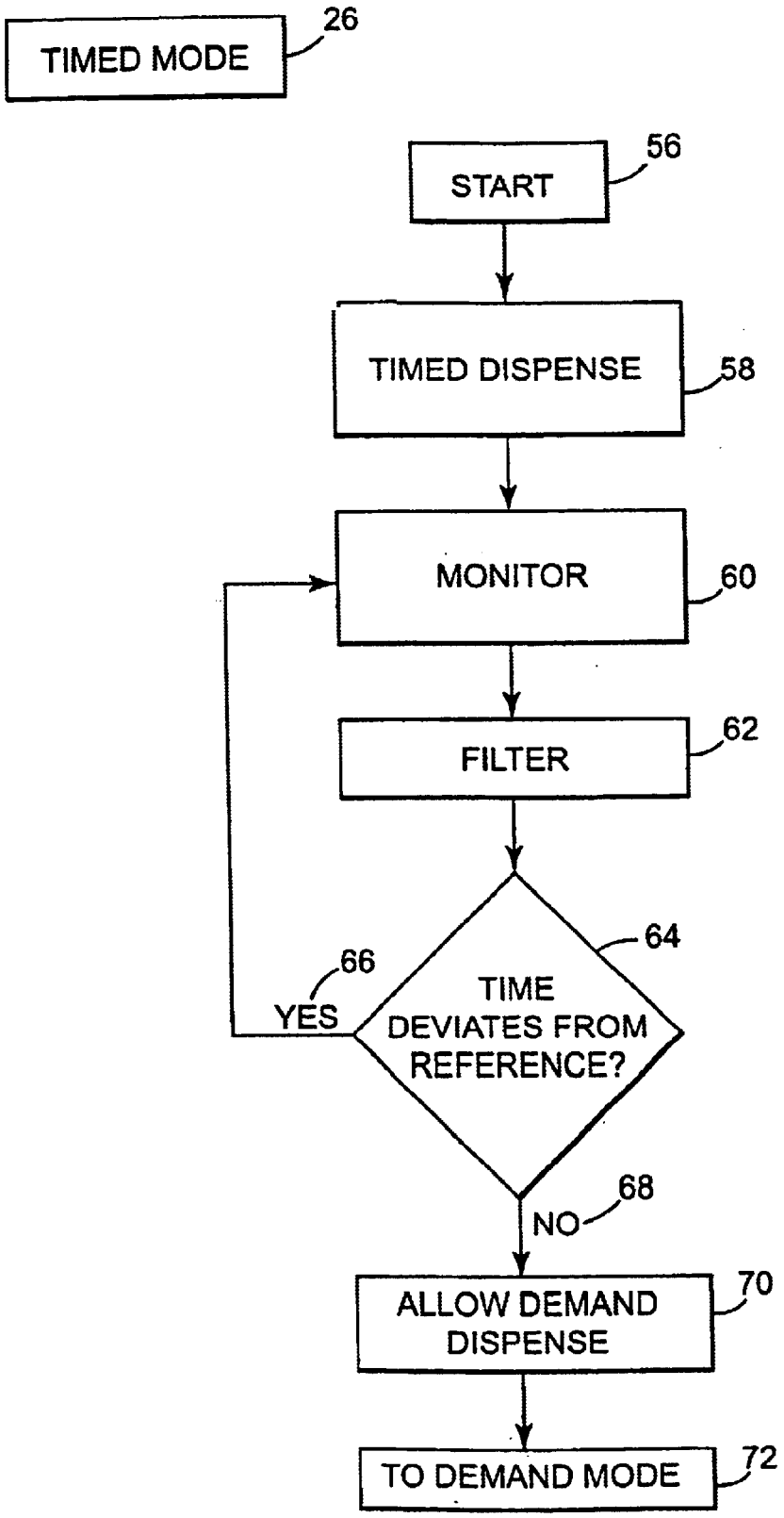
FIG. 5 is a flow diagram illustrating operation of a timed mode of the present invention.

In FIG. 5, timed mode 26 starts in step 56 changing for the previous automatic demand driven feedback system to a probeless, or timed, algorithm 58. With timed algorithm 58, feed mechanism 12 is activated on a timed schedule determined either by the reference value or otherwise predetermined.

In one embodiment, timed mode 26 could terminate only upon a manual reset, such as following repair by a qualified service technician. However, in a preferred embodiment, timed mode 26 continues to measure (60) the active time of feed mechanism 12, filter (62) the sampled measurements and compares (64) the filtered measurements similarly to that done in demand mode 24. If the measured active time continues to deviate significantly (66) from the reference value (using either the same or a different criteria for significant), then controller 16 returns to monitor (60), filter (62) and compare (64).

If, however, the result of the comparison (64) of the measured active time of feed mechanism 12 with the reference value returns (68) to within an established allowable deviation, controller 16 may then again allow (70) demand dispensing of detergent 14 and return (72) to demand mode 24.

Since over time, the measured value of active time of feed mechanism 12 will always return to within an acceptable deviation from the reference value (since the feed mechanism is being driven on the basis of the reference value), the controller will switch back to demand mode even though a repair has not been made. Once in demand mode, if the malfunction continues, the measured value will again deviate from the reference value and controller 16 will again revert to timed mode. This system can result in "hunting" back and forth between demand and timed modes, however, the long time constants will still result in a more stable system. Further, this system allows a self-repair should the malfunction actually be alleviated without manual skilled technician service. This could occur, for example, if a leaky drain due a foreign particle stuck in a valve dislodges and allows normal operation to return.

While the present invention has been described in relation to the control of detergent in a warewashing machine, it is to be recognized and understood that the present invention has applicability in any environment where an ingredient is dispensed to a machine on the basis of a parameter obtained for the machine and in which the amount of ingredient dispensed is a function of the amount of time the dispenser is active.

Various modifications and alterations of this invention will be apparent to those skilled in the art without departing from the scope and spirit of this invention. It should be understood that this invention is not limited to the illustrative embodiments set forth above.

What is claimed is:

1. A method of dispensing ingredient for a machine, said machine have a ingredient feed mechanism operatively coupled to dispense said ingredient to said machine and adapted to receive said ingredient; and a controller capable of controlling an amount of said ingredient delivered to said machine by varying an amount of time said ingredient feed mechanism is active, comprising the steps of:

varying, in a demand mode, said amount of time said ingredient feed mechanism is active as a function of a concentration of said ingredient in said machine;

comparing said amount of time said ingredient feed mechanism is active with a reference value;

switching to a time mode in which said ingredient is delivered as a function of time if said amount of time deviates from said reference value beyond a first predetermined deviation;

which first, in a training mode, measure said amount of time said ingredient feed mechanism is active over a predetermined period of time while delivering said ingredient in accordance with said parameter and establishes said reference value based upon said amount of time said ingredient feed mechanism is active.

2. A method of dispensing as in claim 1 wherein said amount of time is determined by a moving average.

3. A method of dispensing as in claim 2 wherein said moving average is determined by an FIR filter having a time constant of at least one hour.

4. A method of dispensing as in claim 3 wherein said time constant is at least three hours.

5. A method of dispensing as in claim 4 wherein said time constant is between three hours and four hours.

6. A method of dispensing detergent for a warewashing machine, said warewashing machine have a detergent feed mechanism operatively counted to dispense said detergent to said warewashing machine and adapted to receive said detergent; and a controller capable of controlling an amount of said detergent delivered to said warewashing machine by varying an amount of time said detergent feed mechanism is active, comprising the steps of:

varying, in a demand mode, said amount of time said detergent feed mechanism is active as a function of a concentration of said detergent in said warewashing machine;

comprising said amount of time said detergent feed mechanism is active with a reference value;

switching to a timed mode in which said detergent is delivered as a function of time if said amount of time deviates from said reference value beyond a first predetermined deviation;

which first, in a training mode, measure said amount of time said detergent feed mechanism is active over a predetermined period of time while delivering said detergent in accordance with said parameter and establishes said reference value based upon said amount of time said detergent feed mechanism is active.

7. A method of dispensing as in claim 6 wherein said amount of time is determined by a moving average.

8. A method of dispensing as in claim 7 wherein said moving average is determined by an FIR filter having a time constant of at least one hour.

9. A method of dispensing as in claim 8 wherein said time constant is at least three hours.

10. A method of dispensing as in claim 9 wherein said time constant is between three hours and four hours.

* * * * *

UNITED STATES PATENT AND TRADEMARK OFFICE

CERTIFICATE OF CORRECTION

PATENT NO. : 6,819,977 B2
DATED : November 16, 2004
INVENTOR(S) : Ronald B. Howes, Jr. et al.

It is certified that error appears in the above-identified patent and that said Letters Patent is hereby corrected as shown below:

Column 7,
Line 47, delete "time" and insert therefore -- timed --

Column 8,
Line 19, delete "counted" and insert therefore -- coupled --

Signed and Sealed this

Twenty-eighth Day of June, 2005

JON W. DUDAS
*Director of the United States Patent and Trademark Office*